United States Patent [19]

Montgomery

[11] 3,971,581

[45] July 27, 1976

[54] VARIABLE MAGNETIC LOCK

[76] Inventor: Tom C. Montgomery, Box 421, Big Springs, Tex. 79720

[22] Filed: June 17, 1974

[21] Appl. No.: 479,694

[52] U.S. Cl. ..... 292/251.5
[51] Int. Cl.[2] ..... E05C 19/16
[58] Field of Search ..... 292/251.5, 201, 144

[56] References Cited

UNITED STATES PATENTS

| | | | |
|---|---|---|---|
| 2,587,983 | 3/1952 | Durand | 292/251.5 |
| 2,871,676 | 2/1959 | Miller et al. | 292/251.5 X |

*Primary Examiner*—Richard E. Moore
*Attorney, Agent, or Firm*—Howard E. Moore; Gerald G. Crutsinger

[57] ABSTRACT

A variable remote control locking device comprising an electromagnet arranged to contact a ferrous metal plate to lock a door, a variable current supply for controlling the electromagnet, a remote transmitter and a receiver to control the variable current supply. Force exerted by the electromagnet is varied by a signal from the remote transmitter to the receiver which energizes a relay to change the variable current supply, thereby varying the current to the electromagnet and thereby regulate the force required to open the door.

10 Claims, 2 Drawing Figures

VARIABLE MAGNETIC LOCK

BACKGROUND OF THE INVENTION

Heretofore, no suitable variable remotely controlled locking devices have been devised for enclosures such as refrigerators and freezers.

Heretofore, some locking devices have required a key to unlock the door which is inconvenient because the key is usually located away from the lock or is always being misplaced.

Magnetic latches heretofore devised have comprised removable rubber covered elongated magnetic strips secured about the periphery of a refrigerator door. When the door was in the closed position, the magnetic strip was attracted to the metallic facing about the opening closed by the door. Other magnetic locks heretofore employed comprised solenoid controlled latches for holding the door in a closed position. However, neither type of magnetic lock has embodied apparatus to permit control of magnetic force exerted.

Parents are continuously trying to keep their children out of the refrigerator or freezer because of the electrical energy wasted by holding the door open and allowing cold air to escape from the refrigerator. In addition snacking between meals ruins the children's appetite thus making it hard to feed them regular balanced meals which are needed to provide a balanced diet for healthy bodies. Eating between meals also makes it difficult for the cook to prepare proper amounts of food for meals to avoid waste of food.

Heretofore, no device has been developed to allow entry by adults and prohibit entry by children or those who are unauthorized to enter a closure.

SUMMARY OF THE INVENTION

I have devised a variable locking apparatus for enclosures such as a refrigerator so that the force required to open the door is variable. The range of closure force may be varied such that it may be set so that a child cannot open the door but an adult can open it and could be set at a force such that an adult could not open the door.

The locking device comprises an electromagnet with a variable, continuous rotatable resistor which is motor driven by a control unit including a remote signal transmitter. When the remote transmitter transmits a signal, the transducer receives and amplifies the signal which energizes a motor control to actuate the motor to the next contact of a variable current control means such that the current supplied to the electromagnet is varied to change the holding force of the electromagnet. The force exerted by the electromagnet is proportional to the current supplied thereto inasmuch as varying the current supplied thereto will change the degree of force exerted by the electromagnet.

A primary object of the invention is to provide a variable locking device for a refrigerator door or the like which may be set so that a child cannot open same but an adult can open same.

Another object of the invention is to provide a remote variable control for a lock so that one may vary the force exerted by the lock from a remote position.

A further object of the invention is to provide a locking device for a refrigerator or the like that operates without a key.

Other and further objects of the invention will become apparent upon referring to the detailed description hereinafter following and to the drawings annexed hereto.

DESCRIPTION OF DRAWING

Drawings of a preferred embodiment of the invention are annexed hereto so that the invention may be better and more fully understood, in which.

Numeral references are employed to designate the parts shown in the drawings and like numerals designate like parts throughout the various figures of the drawing.

DESCRIPTION OF A PREFERRED EMBODIMENT

Figures 1, 2:
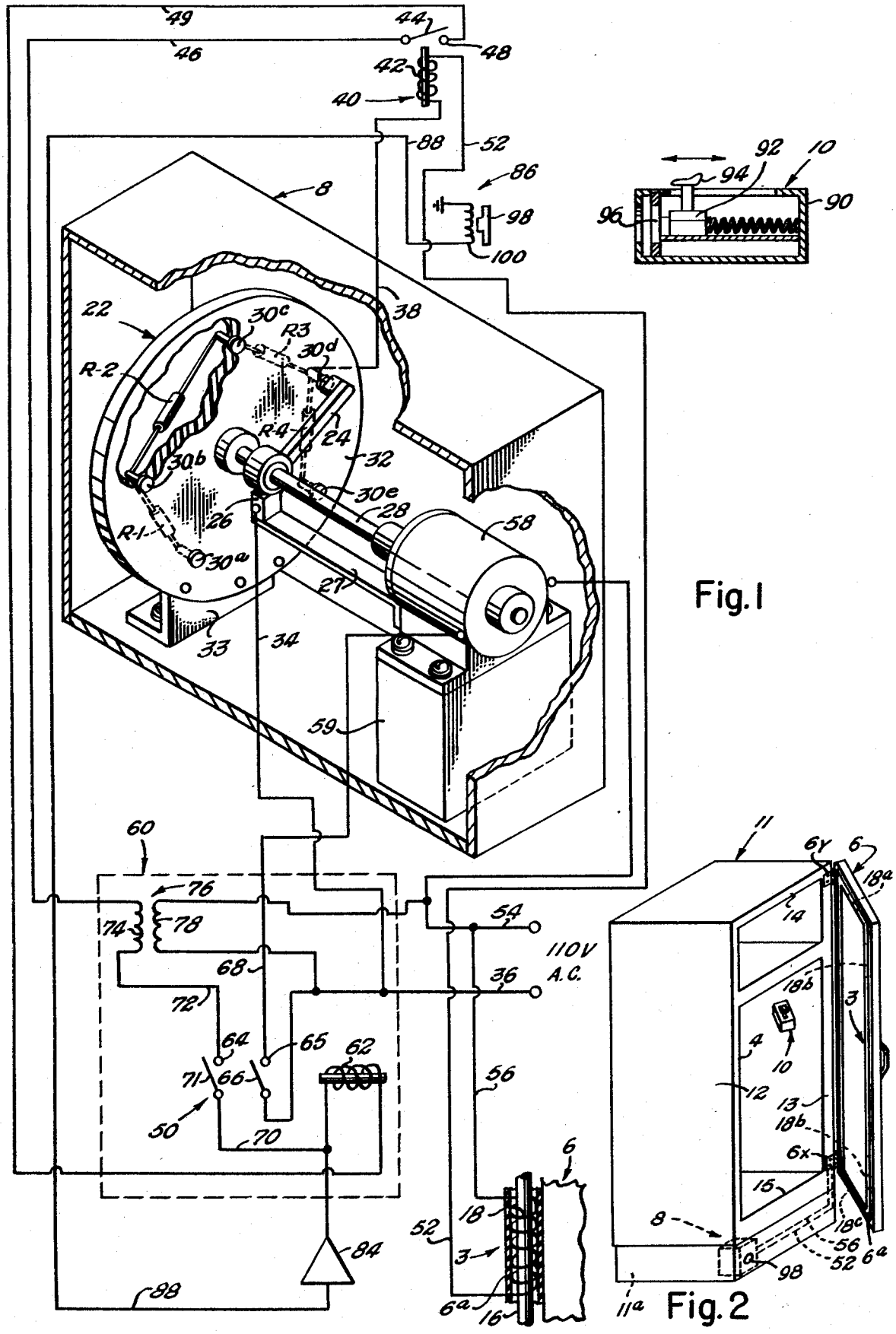
FIG. 1 is a diagrammatic view of the locking device and control system.
FIG. 2 is a perspective view of the refrigerator showing the device mounted thereon.

Illustrated in FIG. 2 of the drawing is a closure having a current responsive lock means 3 secured thereto exerting a magnetic force on a ferrous metal plate 4 so as to hold door 6 closed. Receiver means 8, preferably concealed within the motor compartment 11, varies the current responsive lock means 3 so as to vary the force required to open door 6. Receiver means 8 is energized from a remote position by transmitter 10.

A closure such as refrigerator 11, as illustrated in FIG. 2, comprises side walls 12 and 13, a top 14 and bottom 15 secured to opposite ends of side walls 12 and 13, and a door 6 pivotally secured to side wall 13 by hinges 6*x* and 6*y*. A lower motor compartment 11*a* lies between side walls 12 and 13 and below bottom wall 15.

A current responsive lock means such as an electromagnet 3, comprising an elongated ferrous metal core 16 and coil 18, is secured in stripping 6a extending about the periphery of door 6. Core 16 of electromagnet 3 has end 16a positioned to contact a ferrous metal facing plates 4 secured to side wall 12, and top and bottom walls 14 and 15. It should be appreciated that the force or magnetic intensity exerted by electromagnet 3 is proportional to the electric current flowing through the coil 18. Current is a measure of the flow of charge per second moving in a conductor and magnetic flux is generated by movement of a charge. Thus, the intensity of magnetic flux is increased as the current increases. In addition the current is inversely proportional to the resistance of a circuit. According to Ohm's Law, $I=V/R$, where V equals a constant voltage, R equals resistance, and I equals current.

Suitable control means to vary the current to the electromagnet 3 comprises a variable resistor 22 having wiper arm 24, secured to shaft 28 such that wiper arm 24 is selectively positionable to complete a circuit through contacts 30*a* – 30*e* which are secured to circuit board 32 supported by bracket 33 secured thereon. Resistors R1-R4 are connected in series between contacts 30*a*–30*e* such that rotation of wiper arm 24 in a clockwise direction, as illustrated in FIG. 1, reduces the total resistance of the circuit through variable resistor 22 thus increasing the current flowing therethrough.

Lead 34 connects wiper arm 24 by means of brush assembly 26 to power line 36 and lead 38 connects contact 30*d* to relay 40. Brush assembly 26 is secured by bracket 27 such that wipe arm 24 will rotate between brush assembly 26 and circuit board 32.

Relay 40 comprises relay coil 42, normally closed pole 44 connected to lead 46 and contact 48 which is connected to lead 49. When pole 44 of relay 40 is opened by coil 42 of relay 40 the holding circuit for relay 50 is broken as will be explained in greater detail hereinafter.

Lead 38 connects contact 30d with one side of relay coil 42. The other side of relay coil 42 is connected to one side of coil 18 of electromagnet 3 by lead 52. The other side of coil 18 of electromagnet 3 is connected to power line 54 by lead 56.

In the position illustrated in FIG. 1, the wiper arm 24 completes a circuit from power line 36 through lead 34, through contact 30*d*, through lead 38, through relay coil 42, through lead 52, through one side of coil 18 of electromagnet 3, and through ground lead 56 to the power line 54. When current flows through the circuit, electromagnet 3 is energized to form a magnetic field to attract plate 4 thereto to hold the door 6 shut. It should be appreciated that as wiper arm 24 moves clockwise as illustrated in FIG. 1, the resistance will be reduced and the current will increase thus creating a higher intensity of magnetic flux to pull on door 6 thereby requiring a greater force to open door 6.

It should be further appreciated that other suitable control means to vary the current input to coil 18 may be substituted for variable resistor 22 such as variable parallel resistors of increasing value, a potentiometer, current amplification circuits, and the like.

As illustrated in the drawing resistor R4 connects contact 30e with lead 38. R4 is preferably of a high resistance so that when wiper arm 24 is in that position coil 18 exerts sufficient force on door 6 to seal the gasket 6a around the door 6 of the refrigerator 11 but the force will also be limited so that door 6 will not be difficult to open. Also ferrous core 16 has a small residual magnetic force sufficient to keep door 6 closed when wiper arm 24 moves between contacts 30.

Suitable means such as motor 58 secured to mounting block 59 is connected to shaft 28 to advance wiper arm 24 of variable resistor 22 to vary the current through the coil 18.

Suitable means such as starting circuit 60 is provided to control motor 58. Starting circuit 60 comprises a relay 50 having a coil 62, and a normally open set of contacts 64 and 65. Pole 66 connects power line 36 through contact 65 and through lead 68 to one side of motor 58. The other side of motor 58 is connected to power line 54. Lead 70 connects relay coil 62 to pole 71 of contact 64 which is connected by lead 72 to the secondary coil 74 of transformer 76 having a primary coil 78 connected to power lines 36 and 54. The other side of secondary coil 74 is connected to pole 44 of relay 40 by lead 46, and normally closed contact 48 of relay 40 connects to lead 49 which connects to the other side of coil 62.

It should be readily apparent that upon energizing relay 50 poles 66 and 71 close. Pole 66 forms a circuit from power line 36 through contact 65, through lead 68 to motor 58 to actuate motor 58, moving wiper arm 24 clockwise to the next contact.

Pole 71 forms a holding circuit for coil 62 of relay 50 through lead 70, through contact 64, through lead 72, through secondary coil 74 of transformer 76 and through pole 44 of relay 40 to the other side of coil 62. Coil 42 of relay 40 becomes de-energized upon receiving a signal from transmitter 10 which moves wiper arm 24 off contact 30d breaking the circuit to coil 42. It should be readily apparent that when wiper arm 24 completes a circuit through the next contact, relay 40 is energized, opening normally closed contact 44, breaking the holding circuit of relay 50 and opening contacts 66 and 71 of relay 50 to stop motor 58.

It should be appreciated that other suitable means may be employed to turn wiper arm 24 such as a control knob secured to shaft 28 mounted to the exterior of refrigerator 11 which could be adjusted manually.

Coil 62 of relay 50 is initially energized by an electrical signal received from amplifier 84. A sound signal is transmitted from transmitter 10 and is received by transducer 86 which changes the mechanical sound vibrations into electrical impulses. These impulses are transmitted through lead 88 to amplifier 84. Amplifier 84 is a common-emitter type amplifier which increases the strength of the electrical signal transmitted such that the signal will be strong enough to energize coil 62. The amplifier of the preferred embodiment is a remote control television component (Model Number PW 900) manufactured by RCA.

The remote transmitter 10 comprises a housing 90, a spring urged hammer 92 slideably disposed in housing 90, having a slide button 94 secured to hammer 92 such that as slide button 94 is pulled back the spring will urge hammer 92 forward when slide button 94 is released, hitting striker plate 96 which will vibrate at a resonance frequency between 20 and 30 kilocycles.

The sound signal transmitted by transmitter 10 is received by transducer 86 having a magnetic diaphragm 98 which moves adjacent to coil 100 similar to a telephone receiver, such that vibrations in the range of 20 to 30 kilocycles will cause the magnetic diaphragm 98 to vibrate setting up a moving magnetic field. The pulsating magnetic field from the diaphragm 98 induces an electrical current in coil 100 by virtue of magnetic induction. The converted electrical signal is then conducted through lead 88 to amplifier 84. One side of coil 100 is grounded to complete the circuit. The transducer 86 as illustrated in the preferred embodiment is a remote control television component (Model No. 13309) manufactured by RCA.

Operation of the invention heretofore described is as follows:

A signal is transmitted from transmitter 10 to transducer 86 which is then amplified by the amplifier 84 to energize coil 62 of relay 50, closing poles 71 and 66 of relay 50. This energizes motor 58 which advances wiper arms 24 to the next contact.

Upon reaching the next contact relay 40 is energized thus breaking the holding circuit and stopping the motor 58 and electromagnet 3 is at the next station for holding door 6.

When another force is desired for holding door 6 the process is repeated by transmitting another signal from transmitter 10.

While a signal core 18 is illustrated in FIG. 1 of the drawing to magnetically maintain door 6 in a closed position, it should be appreciated that several cores 18*a*, 18*b*, and 18*c* will preferably be placed in the door gasket 6*a*. Leads 52 and 56 extend from motor compartment 11*a* and along lower hinge 6*x* into gasket 6*a* positioned around the periphery of door 6. It should further be appreciated that core 3 may be secured to side wall 12 of the refrigerator, if it is deemed expedient to do so, such that a ferrous metal surface on door 6 is attracted theretoward.

It should be appreciated that other and further embodiments of the invention may be devised without departing from the basic concept thereof.

Having described my invention, I claim:

1. In combination with an enclosure having a door hingedly secured thereto: an electric current responsive lock means positioned to hold said door closed, said electric current responsive lock means comprising: an electromagnet having a coil secured about a ferrous core, a magnetic attracting element attached to the enclosure, and means securing said core to said door; an electric current supply; means for connecting the lock means to the electric current supply to activate the lock means; and control means adapted to vary the electric current supplied to the lock means to thereby adjust the force required to disengage the lock means, said control means comprising: a circuit board, electrically conductive contacts spaced about the circuit board, a shaft rotatably secured to the circuit board, a wiper attached in series with the current supply source secured to said shaft, said wiper being postionable to selectively complete a circuit with one of said contacts, resistors connected in series between the contacts and the current supply, and means to rotate the shaft.

2. The combination called for in claim 1 wherein the means to rotate the shaft comprises an electric motor; and a starting circuit to control the motor.

3. The combination called for in claim 2 wherein the starting circuit comprises a current responsive relay; means to connect the relay to the motor; transducer means for changing an audio signal into electrical current; means to amplify said current; and audio signal transmitter means to generate an audio signal to the transducer means.

4. In a device of the class described, an enclosure having an opening therein; a door hingedly mounted to the enclosure arranged to close the opening; an electromagnet attached to the door; a magnet attracting member attached to the enclosure adjacent the opening; said magnet attracting member being positionable adjacent said electromagnet; a circuit to supply electric current to the electromagnet; resistance means in series in the circuit to supply current to the electromagnet; and means to vary the resistance means.

5. The combination called for in claim 4 wherein the means to vary the resistance comprises a plurality of separate resistors; contacts in the circuit between the resistors; and an arm in the circuit rotatable between the contacts to selectively place the resistors in the circuit.

6. The combination called for in claim 5 with the addition of a motor; and means securing said motor in driving relation to said arm.

7. The combination called for in claim 6 with the addition of means for controlling the electric motor from a remote position with relation to the enclosure.

8. The combination called for in claim 7 wherein the means for controlling the electric motor from a remote position comprises a signal transmitter located at a remote position with relation to the enclosure; and a signal receiver attached to the enclosure arranged to convert the signal into electric current to operate the motor.

9. The combination called for in claim 8 wherein the signal transmitter is a resonance vibrator type of transmitter and the signal receiver is a transducer arranged to convert the vibratory signal emitted by the transmitter into electric current.

10. A lock for an enclosure having an opening therein: a closure removably secured to the enclosure arranged to close the opening; an electromagnet attached to the closure; a magnetic attracting member attached to the enclosure adjacent the opening, said magnet attracting member being positionable adjacent said electromagnet; means to supply electric current to the electromagnet; means to vary the current supplied to the electromagnet; a sound receiver; actuator means operably connected to said sound receiver and to said means to vary current supplied to the electromagnet; and a sound signal transmitter.

* * * * *